United States Patent [19]

Dornier

[11] Patent Number: 4,608,767

[45] **Date of Patent: * Sep. 2, 1986**

[54] DRYING APPARATUS FOR TUBULAR TEXTILE WARES

[75] Inventor: Peter Dornier, Lindau/Bodensee, Fed. Rep. of Germany

[73] Assignee: Lindauer Dornier Gesellschaft mbH, Lindau/Bodensee, Fed. Rep. of Germany

[ * ] Notice: The portion of the term of this patent subsequent to May 8, 2001 has been disclaimed.

[21] Appl. No.: 607,940

[22] Filed: May 7, 1984

Related U.S. Application Data

[63] Continuation-in-part of Ser. No. 320,739, Nov. 12, 1981, Pat. No. 4,446,632.

[30] Foreign Application Priority Data

Jul. 19, 1983 [DE] Fed. Rep. of Germany ..... 3325918

[51] Int. Cl.[4] ..... F26B 13/12

[52] U.S. Cl. ..... 34/103; 34/104; 26/81; 26/85; 68/20

[58] Field of Search ..... 34/103, 104; 26/81, 26/85; 68/13 R, 20

[56] References Cited

U.S. PATENT DOCUMENTS 3,257,735 6/1966 Catallo ..... 34/158
4,266,983 5/1981 Laszlo et al. ..... 26/81
4,269,046 5/1981 Strahm et al. ..... 68/13 R
4,337,630 7/1982 Strahm ..... 68/13 R
4,446,632 5/1984 Dornier ..... 68/20

FOREIGN PATENT DOCUMENTS 694499 7/1953 United Kingdom .

*Primary Examiner*—Albert J. Makay
*Assistant Examiner*—David W. Westphal
*Attorney, Agent, or Firm*—W. G. Fasse; D. H. Kane, Jr.

[57] ABSTRACT

Three consecutive work zones are provided in a drying apparatus for tubular textile wares, equipped with an expander arranged vertically floating in the interior of the tubular textile material. Zones, in which drying air is blown from the outside into the tube interior, are located upstream an entry ring which expands the tube and downstream of a corresponding exit ring of the expander, which may be circular, for example. In a third, center zone located between the entry ring and the exit ring of the expander, the tubular textile material is exposed to substantially radially outwardly directed suction of the drying air which may cause undesirable deformation of the tubular textile material. A gas-permeable substantially cylindrical jacket is provided in the center zone. This jacket envelopes the tubular textile material which bears against the inner wall of the jacket during the drying, whereby such deformations are avoided or controlled.

4 Claims, 3 Drawing Figures

FIG. 1
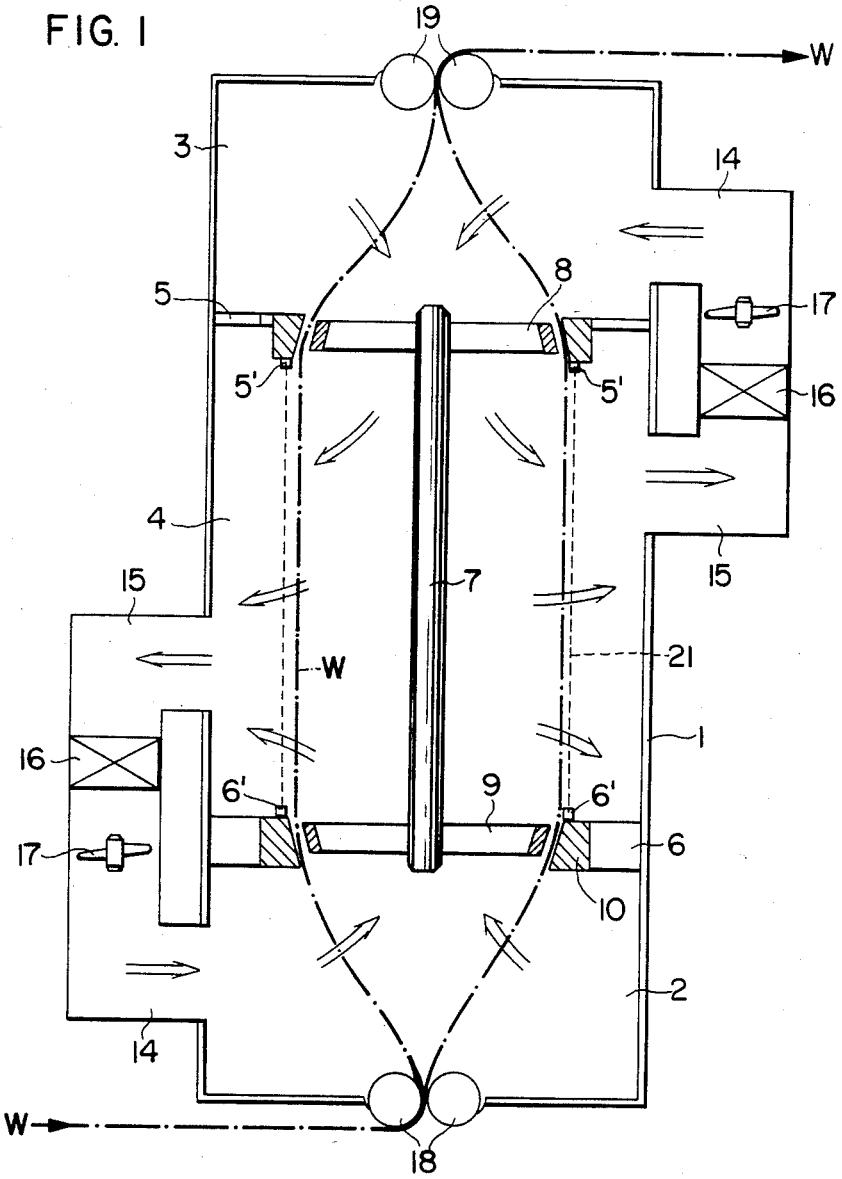
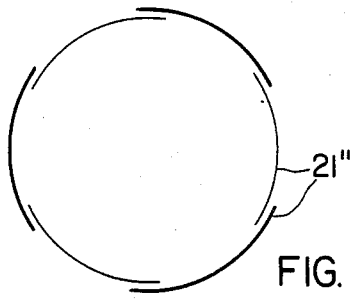
FIG. 3
FIG. 2
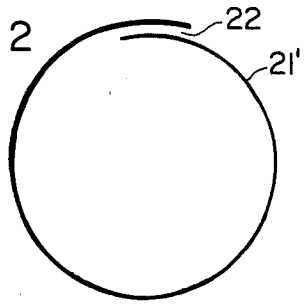

DRYING APPARATUS FOR TUBULAR TEXTILE WARES

CROSS-REFERENCE TO RELATED APPLICATION

The present application is a continuation-in-part application of my copending Ser. No.: 320,739; filed on Nov. 12, 1981; now U.S. Pat. No. 4,446,632.

DESCRIPTION OF THE PRIOR ART

The invention relates to drying equipment for tubular textile wares or goods, with a spreader or expander which may be circular and which is maintained vertically floating for spreading the tubular ware or goods from the inside radially outwardly. Such apparatus has three zones arranged consecutively in the travel direction of the goods. These zones are bounded from each other by a partition extending transverse to the travel direction of the goods. One partition is located in an entry area of the drying apparatus while the other partition is located in a corresponding exit area of the apparatus. Drying air is blown from the outside into the interior of the tubular textile material in these entry and exit areas. The air is guided inside the tubular interior to the center zone thereof and there it is sucked from the inside to the outside of the textile material.

Such drying equipment is described for example in my above copending Ser. No.: 320,739, now U.S. Pat. No. 4,446,632 which discloses an expander in which the entry and exit zones are separated from a central zone by partition rings which are relatively narrow in the travel direction of the goods. These rings comprise axial flow-passageways for the drying air. These entry and exit partition rings are connected to each other by a central support. The drying air may freely pass through the tubular wall of the goods. In the two outer blowing zones the drying air passes from the outside to the inside and in the center suction zone the drying air passes from the inside to the outside. The tubular goods themselves provide a sealing between the partition rings and the entry or exit zone. The longitudinal tension in the tubular ware is low. However, the radial tension required for the drying in the important center zone is provided by the bulging of the tubular goods by the air flow. The circular expander is magnetically held in levitation or flotation, whereby a stable gap is formed between the walls separating the entry and exit zones from the center zone on the one hand and the partition rings of the expander on the other hand. These gaps permit a free and almost frictionless sliding or passing of the tubular goods through the gaps.

In practice it has been found that a free or unrestrained billowing or bulging of the tubular goods may not be suitable for all types of goods because irregularities and distortions may be caused in the goods by such billowing.

OBJECT OF THE INVENTION

In view of the foregoing it is the object of the invention to avoid the billowing and thus also any irregularities and distortions resulting heretofore from such billowing.

SUMMARY OF THE INVENTION

According to the invention drying equipment as described above is improved in that a gas-permeable jacket surrounds the center zone for substantially cylindrically enveloping the tubular wares or goods. Advantageously, the jacket is adjustable or changeable in its diameter for accomodating different tubular sizes of goods or for permitting different degrees of expansion.

BRIEF FIGURE DESCRIPTION

In order that the invention may be clearly understood, it will now be described, by way of example, with reference to the accompanying drawings, wherein:

FIG. 1 is a schematic lengthwise section of a drying apparatus according to the invention;

FIG. 2 is a cross-section through an air permeable jacket surrounding the tubular goods; and FIG. 3 is another type of air permeable jacket.

DETAILED DESCRIPTION OF PREFERRED EXAMPLE EMBODIMENTS AND OF THE BEST MODE OF THE INVENTION

FIG. 1 shows in simplified form a drying apparatus with a circular expander 7, 8, 9 operatively held in a housing 1, into which the tubular goods W moving in the direction of the arrows and indicated by dash-dotted lines are guided from below by intake rollers 18. The goods W pass through an entry zone 2 inside the housing 1 and are transformed by the entry partition ring 9 of the circular expander, from a flat-folded state into a spread-open state to form a tubular member. After the tubular member has passed the exit partition ring 8, the tubular member passes through an exit zone 3, is folded flat again and removed from the exit zone 3 by the exit rollers 19.

The circular expander arranged within the housing 1 in the center zone 4 comprises a central support 7 to the ends of which are attached the entry partition ring 9 and an exit partition ring 8. Advantageously, the entry ring 9 and the exit ring 8 are constructed as circular rings which are supported on the central support 7 for instance by means of spokes or spiders. The radially outer contour or circumferential wall of the annular entry and exit partition rings 9 and 8 is conical. It will be appreciated that the rings 8, 9 need not be circular, any suitable shape, for example an elliptical shape may be used.

The housing 1 is partitioned by two partitions 5 and 6, which are arranged in such a manner that they substantially align with the respective ring 8, 9. Thus, the ring 9 aligns with the partition 6 and the ring 8 aligns with the partition 5. The partitions 5 and 6 each comprise an opening to receive the respective ring 8, 9. These openings in the partitions have a conical wall surface for cooperation with the conical shape of the entry and exit rings 9 and 8 to form a gap sufficient for the passage of the goods. The circular expander is supported and centered by magnetic force in the area of the partitions 5 and 6 in a known manner which need not be further described.

The above mentioned three zones 2, 3, 4 are interconnected for the air flow-through by the holes between the spokes or spider arms of the rings 8, 9. The entry and exit zones 2 and 3 are each provided with a drying air blowing inlet channel 14. The center zone 4 is provided with two suction channels 15. These channels 14, 15 are connected to air conveying means, not shown but located outside the housing 1. The entry ports for the blowing channels 14 and the exit ports for the suction channel 15 are so located in the housing 1 relative to the zones 2, 3 4, that an efficient drying air flow is assured. Furthermore, a heating system 16 and a blower 17 for heating and moving the drying air are inserted into the mentioned channels.

According to the present improvement an approximately cylindrical jacket 21 is arranged in the center zone 4, that is, between the two partitions 5 and 6. This cylindrical jacket 21 is gas-permeable, and for instance is perforated or constructed of a mesh type or netting material. The cylindrical jacket 21 encloses or envelopes the tubular member W to be dried. The attachment of the jacket 21 to the partitions 5 and 6 is achieved by two mounting members 5' and 6' which secure each end of the jacket 21 to the respective partition 5, 6, whereby the jacket 21 envelops or surrounds the member W along its length inside the central air suction zone 4. Thus, the jacket 21 is held sufficiently close to the member W for substantially preventing any billowing of the member W. Advantageously, the cylindrical jacket 21 has adjustable diameter. This may for example be realized by interchanging cylinders having various diameters.

Another possibility of altering the diameter of the cylindrical jacket 21' is shown for example in FIG. 2 in cross-section. In this embodiment the cylindrical jacket 21' is constructed as a mesh screen which may be rolled up since it has an open seam 22.

A further possibility of adjustment of the cylindrical jacket 21" is shown in FIG. 3 illustrating a cylindrical jacket 21" divided into strip-like jacket segments, which overlap each other and which enable a radial adjustment for the purpose of altering the diameter of the jacket.

During the drying process drying air is blown into the two outer zones 2 and 3. In the outer zone 2, during the expansion or unfolding of the tubular member W, the drying air passes through the material into the interior of the tubular member. The air then flows through the flow openings of the entry ring 9 and then further through the interior into the center zone 4. In a similar manner air passes into the center zone 4 of the tube interior through the other outer zone 3 even as the tubular member is being flattened again. In the center zone 4, that is, in the most important zone of the dryer, the wall of the tubular member is traversed by the drying air from the inside to the outside, whereby the tubular member is inflated and thereby receives the required transverse tension. The flow paths of the drying air are shown in FIG. 1 by the double line arrows.

The gas-permeable cylinder jacket 21, 21', 21" limits the free billowing of the tubular member W, which at least partially lies against the inner wall of the jacket 21. The drying air penetrates the wall of the perforated cylindrical jacket 21 as well as the wall of the tubular member W, and then is guided to flow in the drying circuit. Irregularities and distortions in the tubular member are thus avoided by limiting the free billowing or bulging of the tubular member. The jacket diameter may be chosen narrower or wider according to any particular requirements, and according to the type of goods being dried.

Although the invention has been described with reference to specific example embodiments, it will be appreciated, that it is intended to cover all modifications and equivalents within the scope of the appended claims.

What is claimed is:

1. A drying apparatus for tubular textile material, comprising a housing, three air flow zones in said housing separated by two partition means forming a central air suction zone between two air blowing zones, air outlet means (15) in said housing communicating with said air suction zone, air inlet means (14) in said housing communicating with said air blowing zones, said air suction zone having a defined length beween said two partition means, an expander levitated in said central air suction zone for expanding the tubular textile material as it travels through said central air suction zone in which air is sucked through the wall of the textile material from the inside out while in said air blowing zones air is blown into the tubular textile material from the outside in, gas-permeable jacket means (21, 21', 22") separate from said air suction zone, said separate gas-permeable jacket means being operatively located in said suction zone inside said housing means axially between said partition means, mounting means on each of said two partition means, said mounting means facing each other and into said air suction zone, for securing said separate gas-permeable jacket means at both ends to said partition means, said separate gas-permeable jacket means surrounding said tubular textile material along its entire length travelling through said suction zone sufficiently close to said tubular textile material for substantially preventing billowing of said tubular textile material along its entire length inside said suction zone.

2. The drying apparatus of claim 1, wherein said jacket means is constructed to have an adjustable diameter.

3. The drying apparatus of claim 1, wherein said jacket means comprise a mesh screen having an open seam so that the mesh screen may be rolled up for adjusting its diameter.

4. The drying apparatus of claim 1, wherein said jacket means comprise radially adjustable cylinder jacket segments.

* * * * *